US012055151B2

(12) United States Patent
Hu

(10) Patent No.: US 12,055,151 B2
(45) Date of Patent: Aug. 6, 2024

(54) FOLDING DESK FAN

(71) Applicant: Changcai Hu, Xichang (CN)

(72) Inventor: Changcai Hu, Xichang (CN)

(73) Assignee: Shenzhen Xiaohei Technology Electronics Co., Ltd., Shenzhen (CN)

( * ) Notice: Subject to any disclaimer, the term of this patent is extended or adjusted under 35 U.S.C. 154(b) by 0 days.

(21) Appl. No.: 18/418,228

(22) Filed: Jan. 20, 2024

(65) Prior Publication Data

US 2024/0159240 A1 May 16, 2024

(51) Int. Cl.
*F04D 25/08* (2006.01)
*F04D 29/00* (2006.01)
*F04D 29/40* (2006.01)

(52) U.S. Cl.
CPC ..... *F04D 25/08* (2013.01); *F04D 29/002* (2013.01); *F04D 29/403* (2013.01)

(58) Field of Classification Search
CPC ..... F04D 29/703; F04D 25/08; F04D 29/002; F04D 29/403; F04D 29/563; F04D 29/522; F04D 29/601; F04D 29/644; F04D 29/646; F04D 19/002
USPC ..... 417/234; 416/244 R, 246
See application file for complete search history.

(56) References Cited

U.S. PATENT DOCUMENTS 2,123,448 A * 7/1938 Weber ..... F04D 29/646 416/246
2,224,628 A * 12/1940 Benson ..... F04D 29/703 415/126
2,488,306 A * 11/1949 Marsalis ..... F04D 29/646 415/126
2,544,281 A * 3/1951 Seil ..... F04D 29/646 416/247 R
2,600,325 A * 6/1952 Reisch ..... F04D 25/105 416/100
2,620,721 A * 12/1952 Krauss ..... F24F 7/013 415/121.2
2,673,029 A * 3/1954 Lautner ..... F04D 29/646 417/361
2,715,495 A * 8/1955 Ford ..... F04D 29/646 416/246
2,734,990 A * 2/1956 Leuschner ..... A47B 21/06 219/218

(Continued)

FOREIGN PATENT DOCUMENTS

CN 212479636 U * 2/2021 ..... F04D 25/08

*Primary Examiner* — Devon C Kramer
*Assistant Examiner* — Benjamin Doyle

(57) ABSTRACT

A folding desk fan includes a fan shell, a supporting shell and damping members. The fan shell is provided with an air supply component, and elongated openings are arranged on two sides of the fan shell. Two sides of the supporting shell extend upwards to form connecting arms. Free ends of the two connecting arms are oppositely provided with two rotating shafts. The rotating shafts are inserted along the openings. The rotating shafts are able to rotate in the openings and slide in lengthwise directions of the openings to cause the supporting shell to move between a storage position and an open position. And the damping members are connected to the rotating shafts and are located between the rotating shafts and the fan shell. And the damping members are configured to hinder relative rotation between the rotating shafts and the fan shell.

17 Claims, 14 Drawing Sheets

(56) References Cited

U.S. PATENT DOCUMENTS 2,805,820 A * 9/1957 Evarts ..... F04D 29/646 248/223.41
4,789,310 A * 12/1988 Hung ..... F21V 33/0088 417/313
4,799,858 A * 1/1989 Shin-Chin ..... F16M 11/2014 416/246
4,838,151 A * 6/1989 Shin-Chin ..... F24F 7/013 454/200
5,018,951 A * 5/1991 Wang ..... F04D 29/646 16/DIG. 30
5,205,711 A * 4/1993 Raczykowski ..... A62C 3/0207 416/63
5,281,103 A * 1/1994 Lin ..... F04D 25/08 417/423.15
5,370,500 A * 12/1994 Thompson ..... F04D 29/601 248/676
5,435,696 A * 7/1995 Cunning ..... F04D 29/601 416/246
5,505,546 A * 4/1996 Okude ..... F16C 35/02 384/276
5,609,473 A * 3/1997 Litvin ..... F04D 29/601 416/246
5,621,846 A * 4/1997 Smith ..... F24C 7/065 416/246
6,126,415 A * 10/2000 Lasko ..... F24F 7/007 416/246
6,364,618 B1 * 4/2002 Moreno ..... F04D 29/703 415/214.1
6,682,308 B1 * 1/2004 Fei ..... F04D 29/403 416/246
6,863,498 B2 * 3/2005 Liang ..... F04D 25/088 416/142
D546,933 S * 7/2007 Chen ..... D23/382
8,087,899 B2 * 1/2012 Hsu ..... F04D 25/08 416/246
D890,324 S * 7/2020 Xu ..... D23/382
D898,894 S * 10/2020 Breit ..... D23/382
2004/0197189 A1 * 10/2004 Seo ..... F04D 29/703 415/121.2
2008/0014093 A1 * 1/2008 Fan ..... H05K 7/20727 416/244 R
2008/0053049 A1 * 3/2008 Pfannenberg ..... B01D 46/10 454/309
2012/0014811 A1 * 1/2012 Wei ..... F04D 29/601 417/1
2012/0269663 A1 * 10/2012 Kamiya ..... F04D 25/0673 417/411
2013/0033159 A1 * 2/2013 Immel ..... H05K 7/20172 312/236
2013/0108481 A1 * 5/2013 Hoye ..... F04D 25/084 417/234
2013/0315727 A1 * 11/2013 Ho ..... F04D 29/601 415/213.1
2017/0196376 A1 * 7/2017 Leonard ..... F04D 29/545
2018/0355875 A1 * 12/2018 Freeland ..... F04D 25/084
2021/0180601 A1 * 6/2021 Ling ..... F04D 29/053
2022/0290693 A1 * 9/2022 Spaulding ..... F04D 25/08
2023/0417251 A1 * 12/2023 Deng ..... F04D 29/644
2024/0003358 A1 * 1/2024 Schroeder ..... F04D 25/0673
2024/0072707 A1 * 2/2024 Strommen ..... H02J 3/0073

* cited by examiner

FOLDING DESK FAN

BACKGROUND OF THE INVENTION

The present disclosure relates to the technical field of fans, and in particular, to a folding desk fan.

A fan, as a household appliance that generates an air flow by driving fan blades to rotate through a motor, is widely used in daily life of people. The air flow generated by the fan can accelerate air circulation and dissipate heat. The fan is a commonly used cooling tool in the scorching summer. There are many types of fans, including a floor fan, a desk fan, a handheld fan, a neck fan, and the like. Among the many types of fans, the desk fan is particularly popular due to its small volume, portability, and convenience in use.

At present, the existing desk fans on the market usually include a supporting seat and a fan main body. The supporting seat is placed on a mounting plane such as a desktop to fix the product. The fan main body generates an air flow to make a user feel cool. However, this type of product has certain problems. Its volume is usually fixed. When the user needs to move and store the product, the volume of the product is still large, which is not convenient for the user to use. Moreover, it is inconvenient to adjust an angle of the fan, and the structure is unstable.

For this purpose, the present disclosure provides a folding desk fan that can effectively solve the above-mentioned problems. The folding desk fan has a simple structure, can be switched between a stored state and a usage state, and is convenient to use.

SUMMARY OF THE INVENTION

In order to overcome the shortcomings of the prior art, the present disclosure provides a folding desk fan. The folding desk fan has a simple structure, can be switched between a stored state and a usage state, and is convenient to use.

The technical solution adopted by the present disclosure to solve the technical problem is as follows.

A folding desk fan includes:

a fan shell, wherein the fan shell is provided with an air supply component, and elongated openings are arranged on two sides of the fan shell;

a supporting shell, wherein two sides of the supporting shell extend upwards to form connecting arms; free ends of the two connecting arms are oppositely provided with two rotating shafts; the rotating shafts are inserted along the openings; the rotating shafts are able to rotate in the openings and slide in lengthwise directions of the openings to cause the supporting shell to move between a storage position and an open position; and damping members, wherein the damping members are connected to the rotating shafts and are located between the rotating shafts and the fan shell; and the damping members are configured to hinder relative rotation between the rotating shafts and the fan shell.

As the improvement of the present disclosure, the fan shell includes sliding shells; the sliding shells are slidably arranged at positions, close to the openings, in the fan shell; the sliding shells are provided with rotating shaft holes; the rotating shafts are rotatably inserted into the rotating shaft holes; and the damping members are arranged between the rotating shafts and the rotating shaft holes.

As the improvement of the present disclosure, a guide rail block is arranged on an inner wall of the fan shell in a protruding manner; a sliding space is formed between the guide rail block and the inner wall of the fan shell where the openings are located; and the sliding shells slide in the sliding space.

As the improvement of the present disclosure, a first limiting clamping block is arranged on a surface of each sliding shell; a second limiting clamping block is arranged on an inner wall of the fan shell in a protruding manner; and when the supporting shell is at the storage position, the first limiting clamping block is clamped to the second limiting clamping block.

As the improvement of the present disclosure, first abutment blocks are arranged at the free ends of the rotating shafts in a protruding manner; second abutment blocks are arranged on inner walls of the rotating shaft holes in a protruding manner; the second abutment blocks abut against the damping members to clamp the damping members between the rotating shafts and the second abutment blocks; and the second abutment blocks abut against the first abutment blocks to restrain the rotating shafts from moving in an axial direction.

As the improvement of the present disclosure, surfaces of the first abutment blocks in a circumferential direction protrude to form first limiting blocks; second limiting blocks are further arranged on inner walls of the rotating shaft holes; the first limiting blocks abut against the second limiting blocks to limit a rotation angle between the fan shell and the supporting shell.

As the improvement of the present disclosure, each sliding shell includes a first sliding shell and a second sliding shell; the first sliding shell and the second sliding shell are both provided with arc-shaped grooves; the first sliding shell is connected to the second sliding shell; and the two arc-shaped grooves form the rotating shaft hole.

As the improvement of the present disclosure, the connecting arms are provided with first routing channels; the rotating shafts are provided with through holes communicated to the first routing channels; and the through holes and the first routing channels are configured to allow electrical connection wires to pass.

As the improvement of the present disclosure, a first clamping block or a first clamping slot is arranged on one side of the fan shell facing the supporting shell, and a first clamping slot or a first clamping block is arranged on one side of the supporting shell facing the fan shell; and when the supporting shell is at the storage position, the first clamping block is clamped and inserted into the first clamping slot.

As the improvement of the present disclosure, the fan shell is provided with an air inlet and an air outlet; protruding edges are arranged on one side, close to the air outlet, of portions of the fan shell corresponding to the openings; and the edges abut against side surfaces of the connecting arms to hinder the supporting shell from rotating to a front side of the air outlet.

As the improvement of the present disclosure, the folding desk fan further includes a routing shell, wherein the routing shell is connected to an inner wall of the fan shell; a second routing channel is formed between the routing shell and the fan shell; and the second routing channel is configured to allow an electrical connection wire to pass.

As the improvement of the present disclosure, the fan shell includes a first fan shell and a second fan shell; one of the first fan shell and the second fan shell is provided with a second clamping block, and the other one of the first fan shell and the second fan shell is provided with a second clamping slot; and the second clamping block is clamped to the second clamping slot.

As the improvement of the present disclosure, the supporting shell includes a first supporting shell and a second supporting shell; one of the first supporting shell and the second supporting shell is provided with a third clamping block, and the other one of the first supporting shell and the second supporting shell is provided with a third clamping slot; the third clamping block is clamped to the third clamping slot; and an accommodating chamber is formed between the first supporting shell and the second supporting shell.

As the improvement of the present disclosure, a control device is arranged in the accommodating chamber; and the control device is electrically connected to and controls the air supply component.

As the improvement of the present disclosure, the folding desk fan further includes a battery, wherein the battery is electrically connected to the control device and supplies power to the control device and the air supply component.

As the improvement of the present disclosure, the folding desk fan further includes a charging head, wherein the charging head is electrically connected to the control device; a charging hole is arranged on the second supporting shell; and the charging head is threaded through the charging hole.

As the improvement of the present disclosure, the folding desk fan further includes an indicator lamp, wherein the indicator lamp is electrically connected to the control device; the first supporting shell is provided with an indicator lamp hole; and light generated by the indicator lamp passes through the indicator lamp hole.

As the improvement of the present disclosure, the folding desk fan further includes a button, wherein a button hole is arranged on the first supporting shell; a button contact is arranged on the control device; and the button is connected to the first supporting shell and the button contact and is threaded through the button hole.

As the improvement of the present disclosure, the air supply component includes a motor and a fan blade; and an output end of the motor is connected to the fan blade and drives the fan blade to rotate.

The present disclosure has the following beneficial effects. Through the arrangement of the above structure, when the rotating shafts move to upper parts of the openings, the supporting shell moves to the storage position. At this time, the supporting shell tightly abuts against the fan shell, which can effectively reduce the volume of the product and facilitate a user to move, store, or use the desk fan in a hand. When the rotating shafts move to lower parts of the openings, the supporting shell moves to the open position, and the supporting shell is rotated to form an angle between the supporting shell and the fan shell. In this case, the supporting shell can form a supporting bracket supported on a placement plane such as a desktop to fix the product, which effectively frees the hands of the user and makes it convenient for the user to use. Moreover, the damping members can hinder the relative rotation between the rotating shafts and the fan shell to fix the angle between the supporting shell and the fan shell, making it easier for the user to adjust an orientation of the fan and providing a better user experience.

BRIEF DESCRIPTION OF DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE INVENTION

Figure 1:
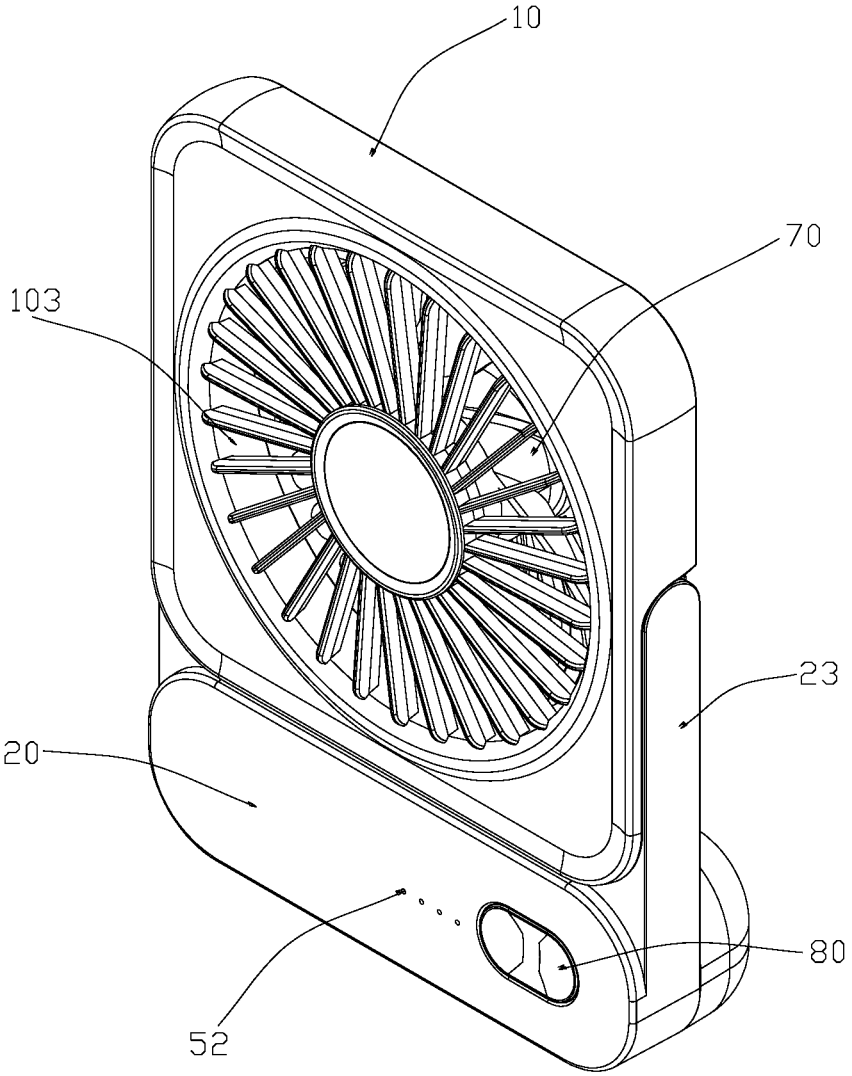
FIG. 1 is a schematic diagram of an entire structure of an angle of a closed state according to the present disclosure.
Figure 2:
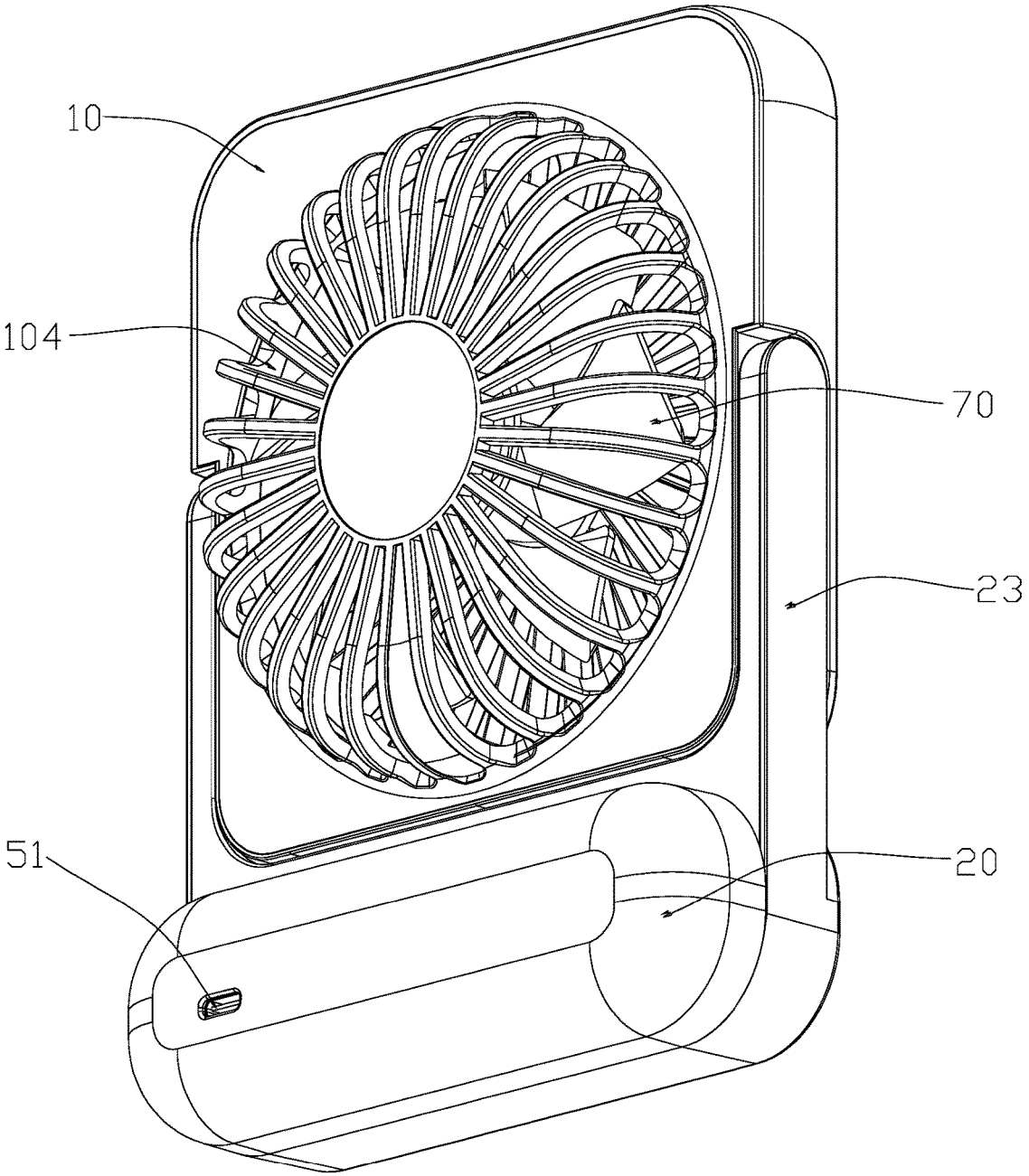
FIG. 2 is a schematic diagram of an entire structure of another angle of a closed state according to the present disclosure.
Figure 3:
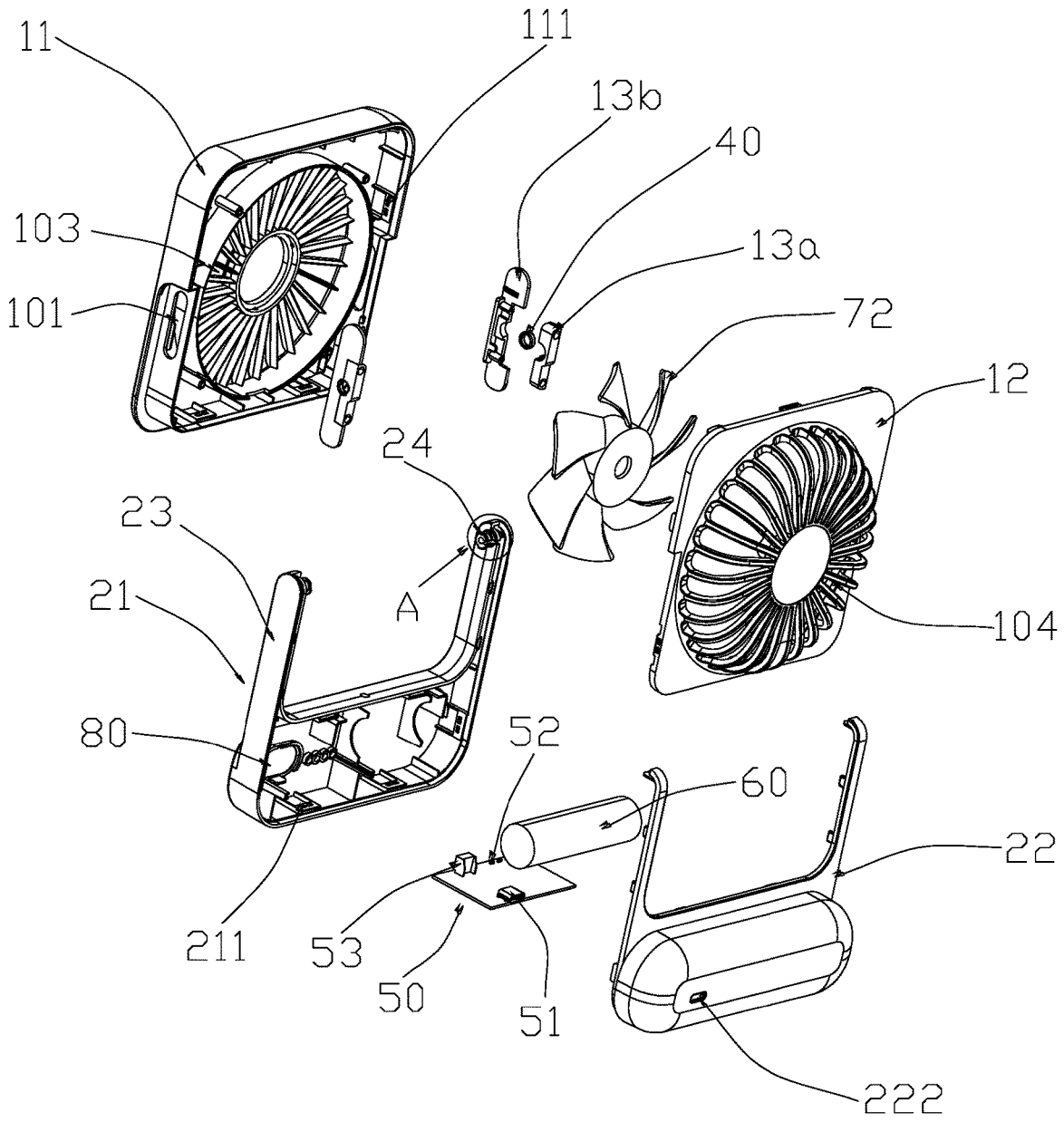
FIG. 3 is a structural exploded diagram of the present disclosure in an angle.
Figure 4:
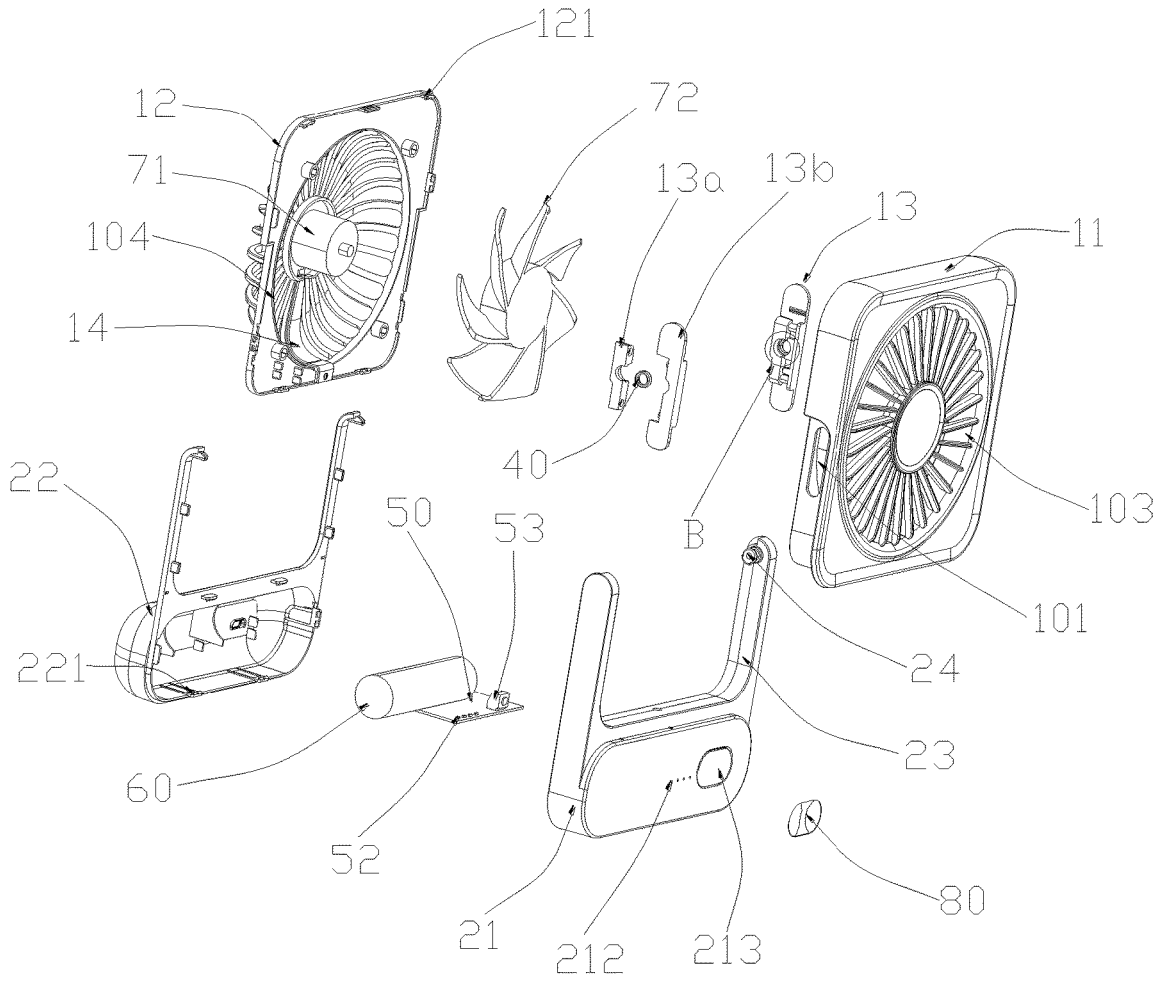
FIG. 4 is a structural exploded diagram of the present disclosure in another angle.
Figure 5:
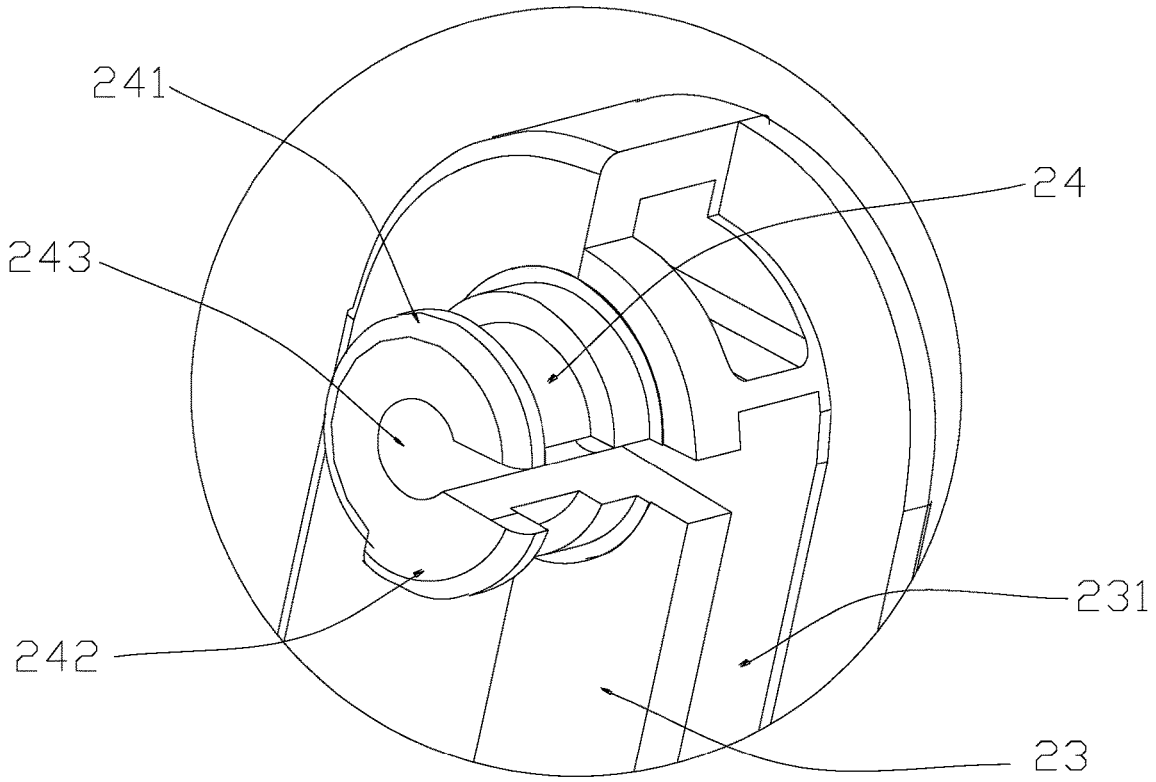
FIG. 5 is an enlarged view of circle A in FIG. 3.
Figure 6:
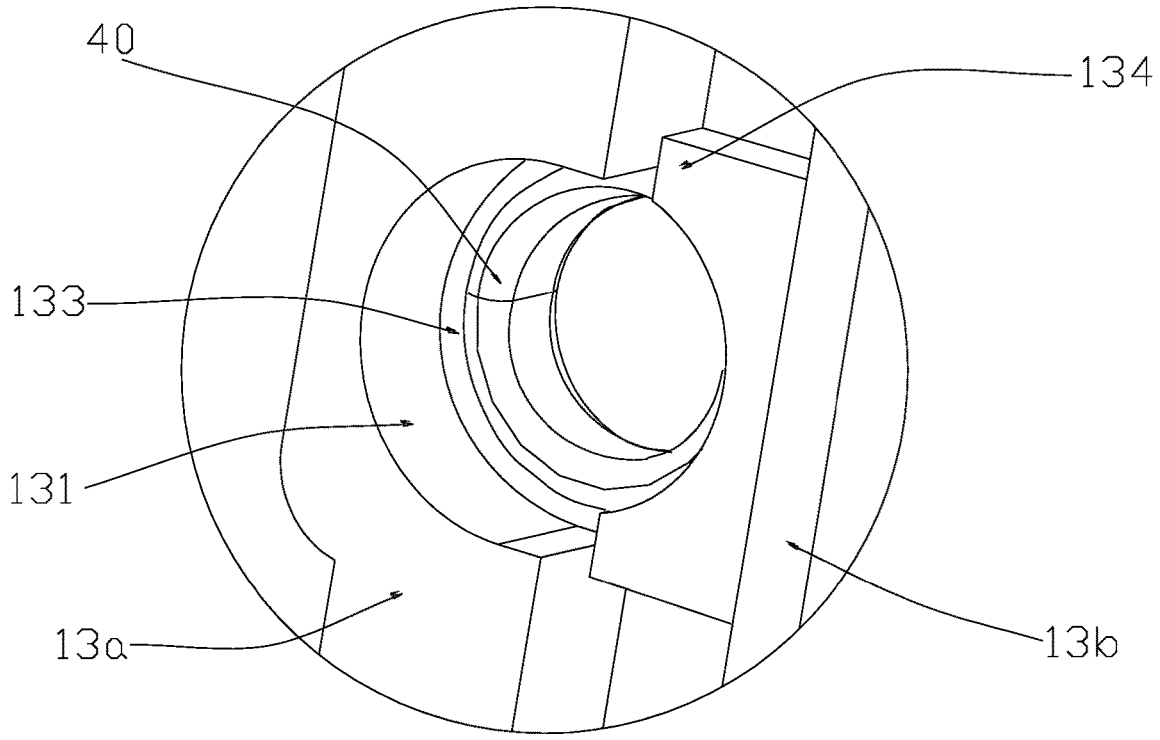
FIG. 6 is an enlarged view of circle A in FIG. 4.
Figure 7:
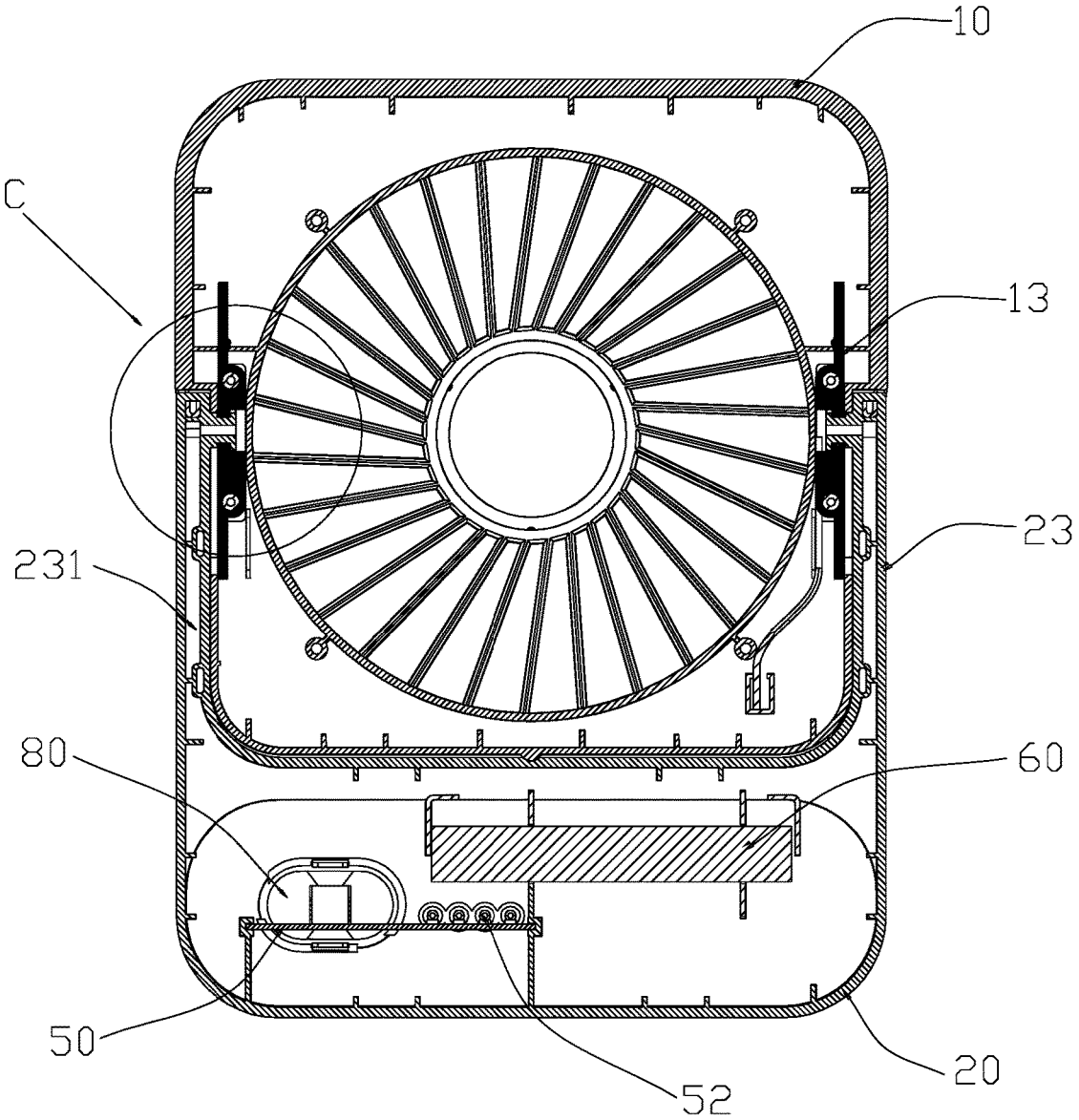
FIG. 7 is a schematic diagram of a cross-sectional structure in a first direction according to the present disclosure.
Figure 8:
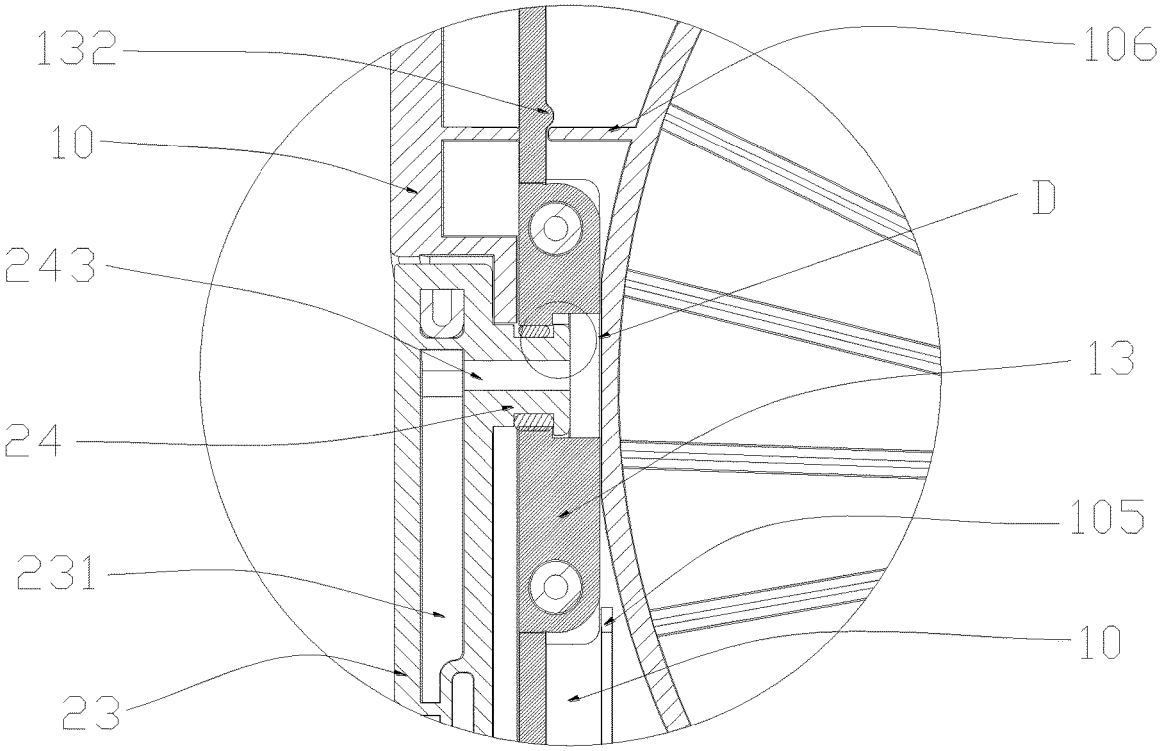
FIG. 8 is an enlarged view of circle C in FIG. 7.
Figure 9:
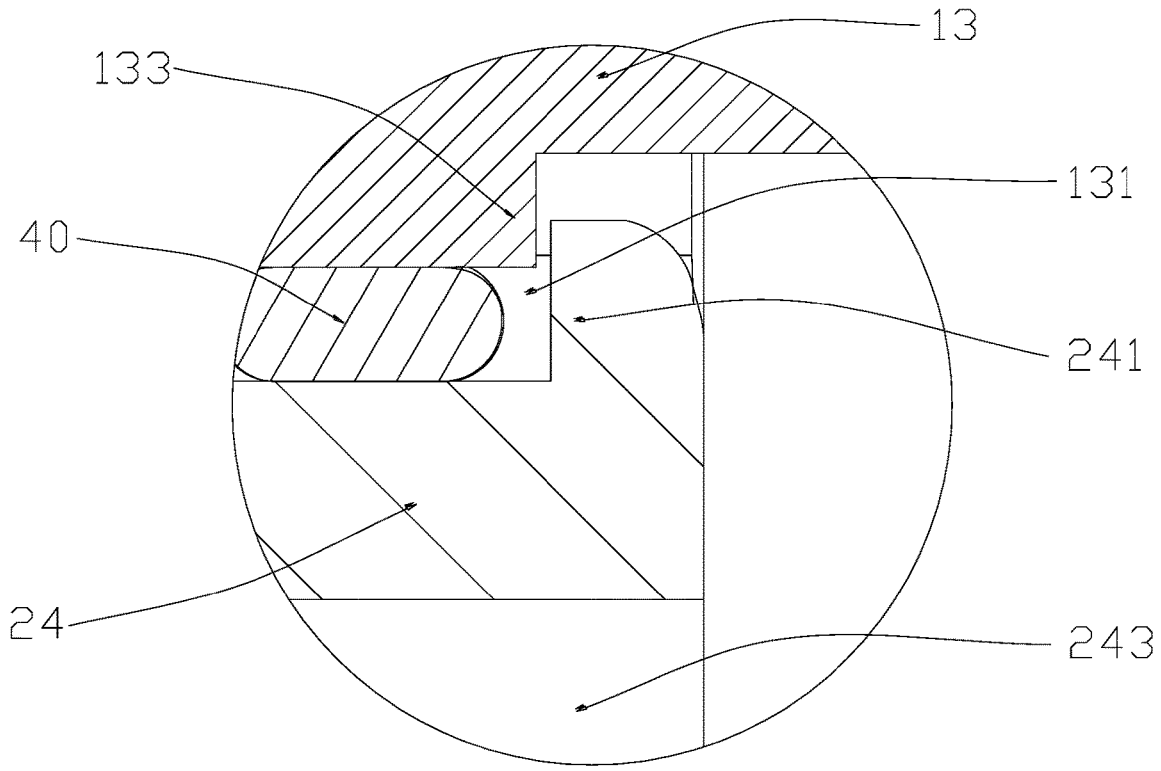
FIG. 9 is an enlarged view of circle D in FIG. 8.
Figure 10:
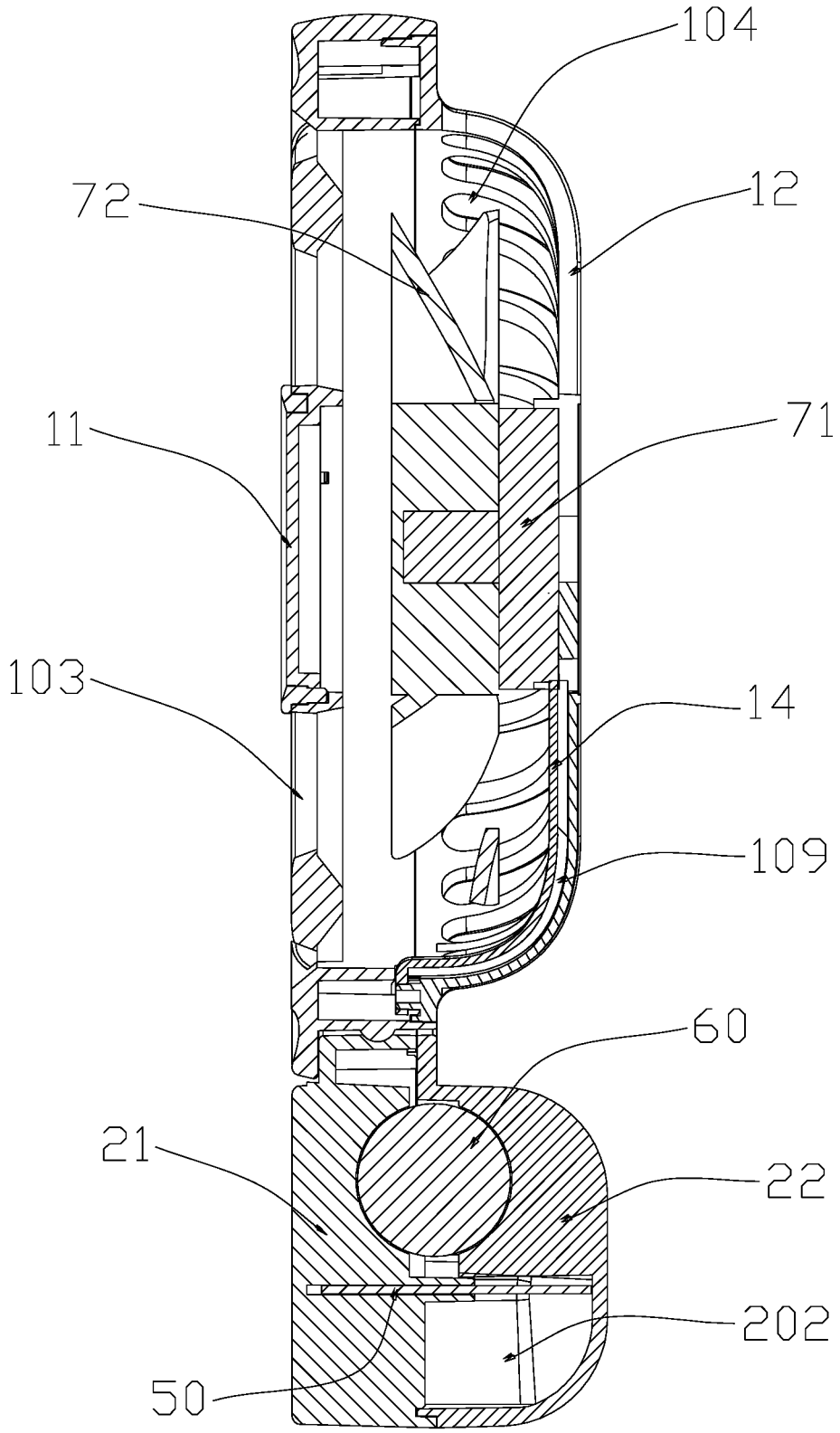
FIG. 10 is a schematic diagram of a cross-sectional structure in a second direction according to the present disclosure.
Figure 11:
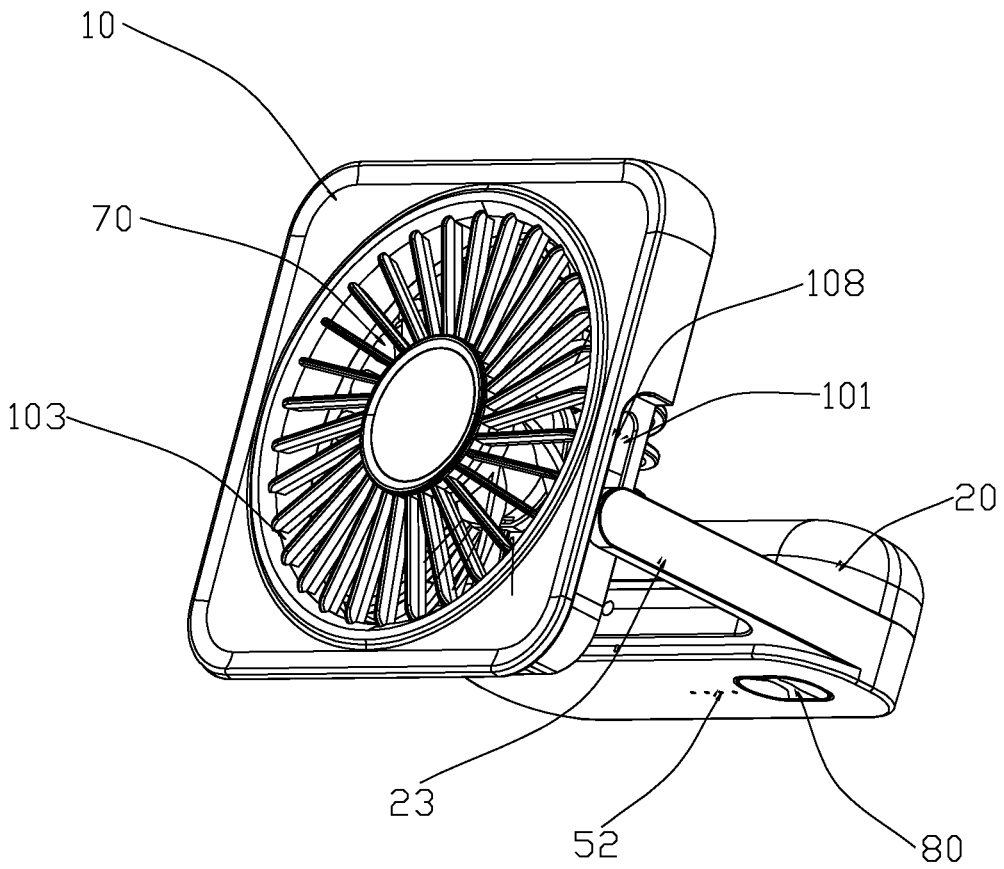
FIG. 11 is a schematic diagram of an entire structure of an angle of an open state according to the present disclosure.
Figure 12:
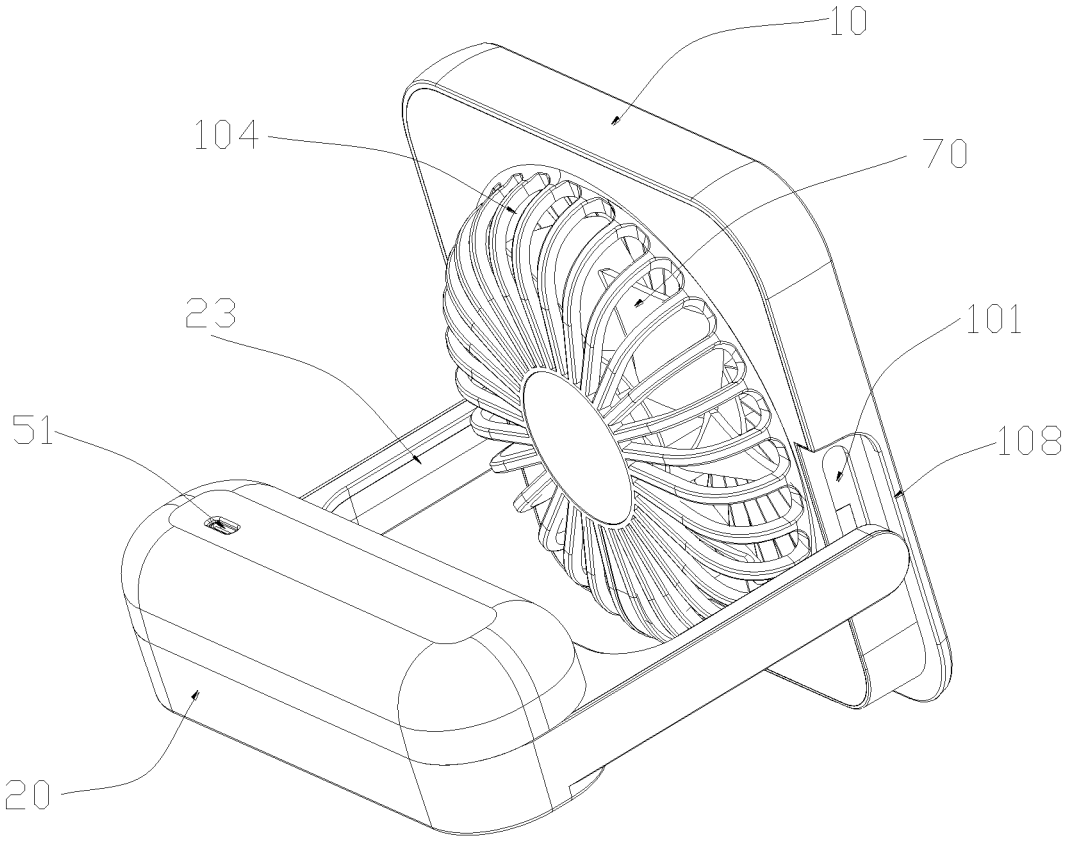
FIG. 12 is a schematic diagram of an entire structure of another angle of an open state according to the present disclosure.
Figure 13:
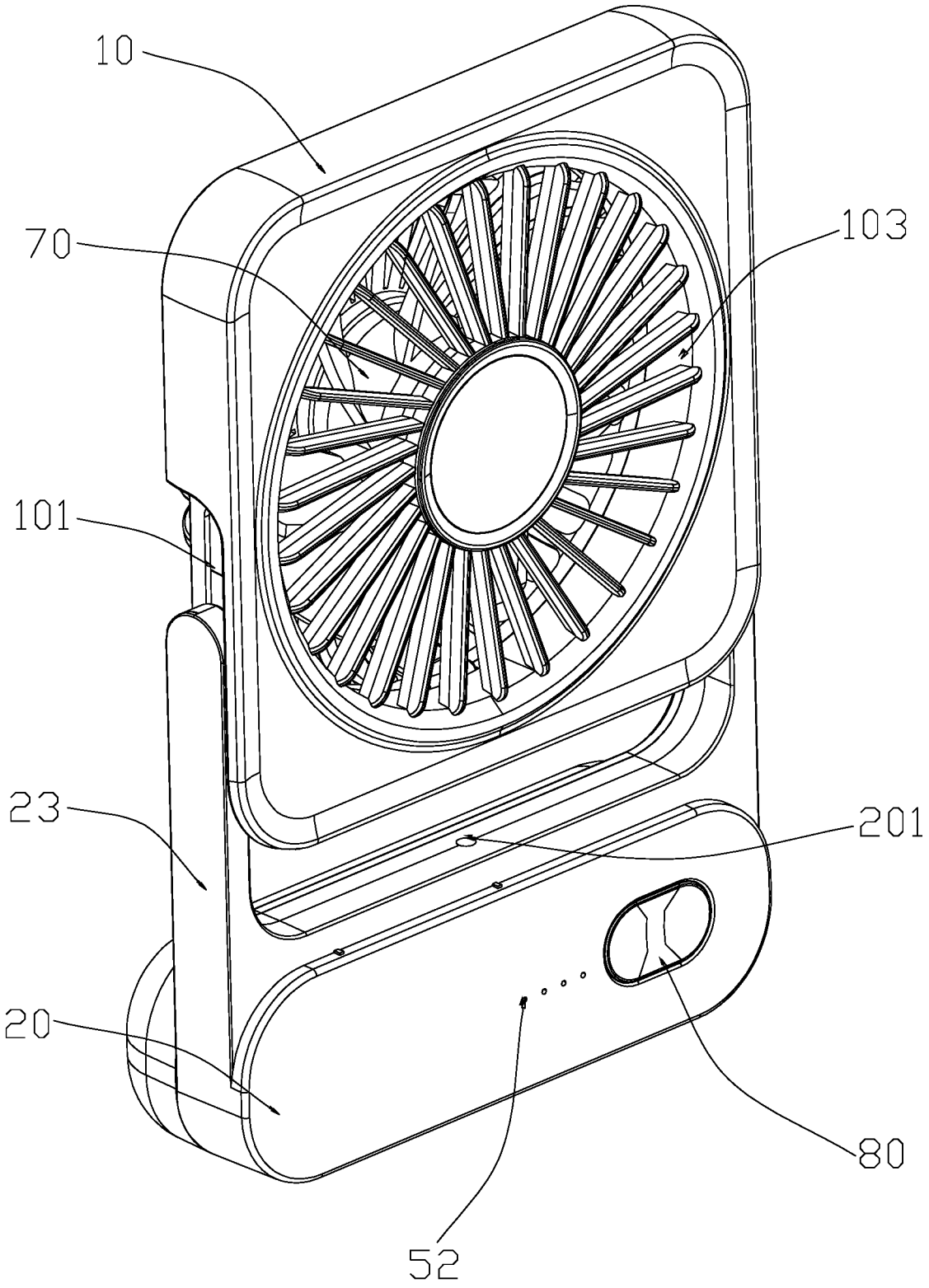
FIG. 13 is a schematic diagram of an entire structure of an angle of an intermediate state according to the present disclosure.
Figure 14:
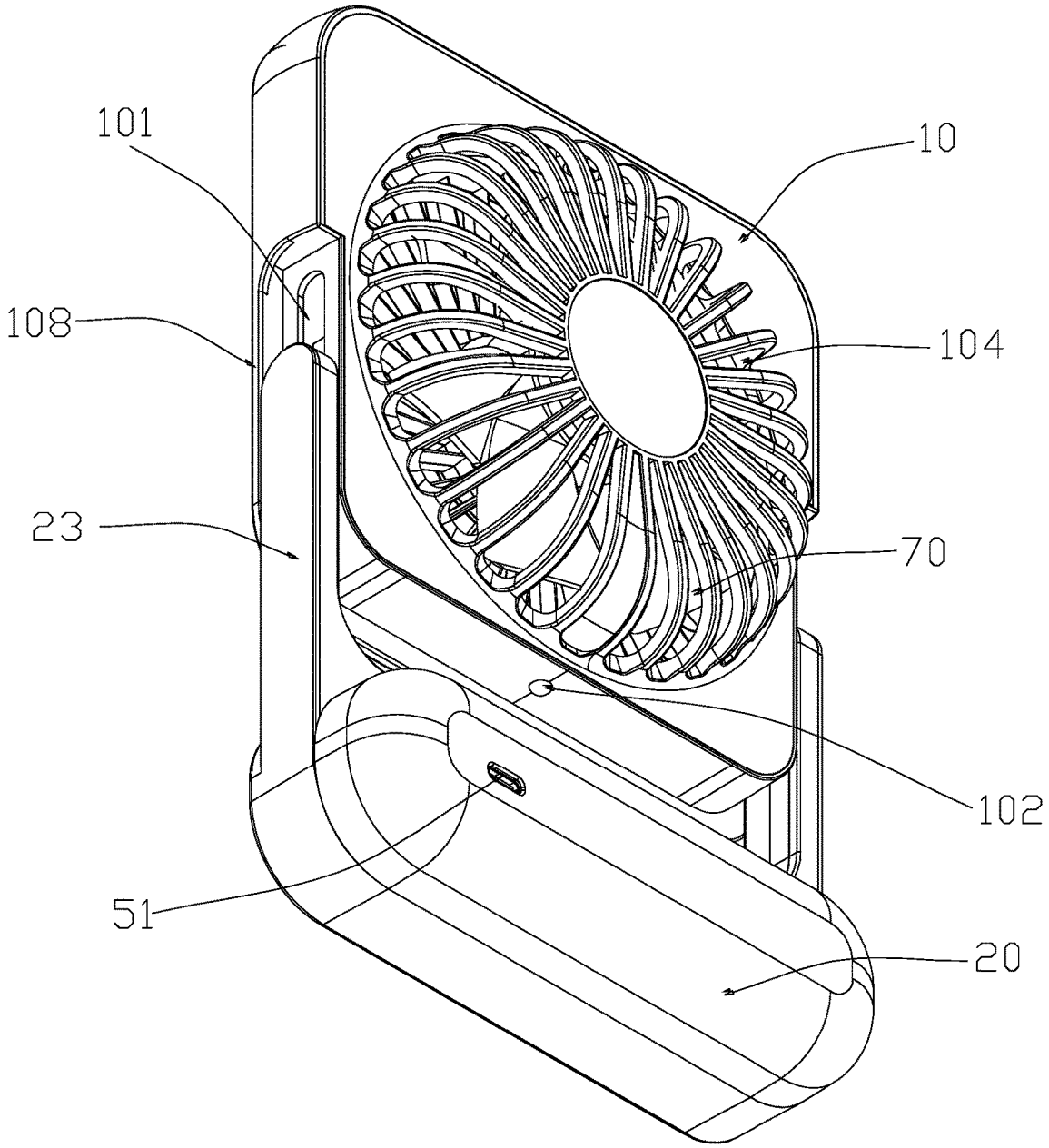
FIG. 14 is a schematic diagram of an entire structure of another angle of an intermediate state according to the present disclosure.

Referring to FIG. 1 to FIG. 14, a folding desk fan includes:

- a fan shell 10, wherein the fan shell 10 is provided with an air supply component 70, and elongated openings 101 are arranged on two sides of the fan shell 10;
- a supporting shell 20, wherein two sides of the supporting shell 20 extend upwards to form connecting arms 23; free ends of the two connecting arms 23 are oppositely provided with two rotating shafts 24; the rotating shafts 24 are inserted along the openings 101; the rotating shafts 24 can rotate in the openings 101 and slide in lengthwise directions of the openings 101 to cause the supporting shell 20 to move between a storage position and an open position; and
- damping members 40, wherein the damping members 40 are connected to the rotating shafts 24 and are located between the rotating shafts 24 and the fan shell 10; and the damping members 40 are configured to hinder relative rotation between the rotating shafts 24 and the fan shell 10.

Through the arrangement of the above structure, when the rotating shafts 24 move to upper parts of the openings 101, the supporting shell 20 moves to the storage position. At this time, the supporting shell 20 tightly abuts against the fan shell 10, which can effectively reduce the volume of the product and facilitate a user to move, store, or use the desk fan in a hand. When the rotating shafts 24 move to lower parts of the openings 101, the supporting shell 20 moves to the open position, and the supporting shell 20 is rotated to form an angle between the supporting shell 20 and the fan shell 10. In this case, the supporting shell 20 can form a supporting bracket supported on a placement plane such as a desktop to fix the product, which effectively frees the hands of the user and makes it convenient for the user to use. Moreover, the damping members 40 can hinder the relative rotation between the rotating shafts 24 and the fan shell 10 to fix the angle between the supporting shell 20 and the fan shell 10, making it easier for the user to adjust an orientation of the fan and providing a better user experience.

In this embodiment, the fan shell 10 sliding shells 13; the sliding shells 13 are slidably arranged at positions, close to the openings 101, in the fan shell 10; the sliding shells 13 are provided with rotating shaft holes 131; the rotating shafts 24 are rotatably inserted into the rotating shaft holes 131; and the damping members 40 are arranged between the rotating shafts 24 and the rotating shaft holes 131. By the arrangement of the above structure, during use, when the rotating shafts 24 move in the lengthwise directions of the openings 101, the rotating shafts 24 drive the sliding shells 13 to slide, which can achieve relative movement between the fan shell 10 and the supporting shell 20. The rotating shafts 24 are rotatably inserted into the rotating shaft holes 131, which can achieve relative rotation between the fan shell 10 and the supporting shell 20. Meanwhile, the damping members 40 are arranged between the rotating shafts 24 and the rotating shaft holes 131, which can provide a friction force to fix the angle between fan shell 10 and supporting shell 20 to facilitate the user to adjust the orientation of the fan.

In this embodiment, a guide rail block 105 is arranged on an inner wall of the fan shell 10 in a protruding manner; a sliding space 107 is formed between the guide rail block 105 and the inner wall of the fan shell 10 where the openings 101 are located; and the sliding shells 13 slide in the sliding space 107. By the arrangement of the above structure, during use, when the rotating shafts 24 move in the lengthwise directions of the openings 101, the rotating shafts 24 drive the sliding shells 13 to slide in the sliding space 107. The guide rail block 105 can limit a movement direction of the sliding shells 13, so that the sliding shells 13 can only move in the lengthwise directions of the openings 101. Moreover, when the rotating shafts 24 rotate in the rotating shaft holes 131, the sliding shells 13 can be hindered from rotating around the rotating shafts 24, ensuring the stability of the product.

In this embodiment, a first limiting clamping block 132 is arranged on a surface of each sliding shell 13; a second limiting clamping block 106 is arranged on an inner wall of the fan shell 10 in a protruding manner; and when the supporting shell 20 is at the storage position, the first limiting clamping block 132 is clamped to the second limiting clamping block 106. By the arrangement of the above structure, when the supporting shell 20 moves to the storage position, the first clamping block 132 is connected to the second clamping block 106, which can limit the movement of the sliding shell 13 in the lengthwise direction of the opening 101, so that the positions of the fan shell 10 and the supporting shell 20 are fixed relatively, which prevents the fan shell 10 from easily moving away from the supporting shell 20, improves the stability of the product at the storage position, and facilitates storage and transportation of the product.

In this embodiment, first abutment blocks 241 are arranged at the free ends of the rotating shafts 24 in a protruding manner; second abutment blocks 133 are arranged on inner walls of the rotating shaft holes 131 in a protruding manner; the second abutment blocks 133 abut against the damping members 40 to clamp the damping members 40 between the rotating shafts 24 and the second abutment blocks 133; and the second abutment blocks 133 abut against the first abutment blocks 241 to restrain the rotating shafts 24 from moving in an axial direction. By the arrangement of the above structure, the first abutment blocks 241 abut against the second abutment blocks 133, which can restrain the rotating shafts 24 from moving in the axial direction and prevent the rotating shafts 24 from being separated from the rotating shaft holes 131, ensuring the stability of the connection between the rotating shafts 24 and the sliding shells 13. Moreover, the second abutment blocks 133 abut against the surfaces of the damping members 40, which can increase friction forces between the damping members 40 and the shaft holes 131, as well as the rotating shafts 24, so that the fan shell 10 and the supporting shell 20 can be fixed in a certain angle, and the product is placed on a supporting plane such as a desktop more stably. This improves the stability of the product and also facilitates use.

In this embodiment, surfaces of the first abutment blocks 241 in a circumferential direction protrude to form first limiting blocks 242; second limiting blocks 134 are further arranged on inner walls of the rotating shaft holes 131; the first limiting blocks 242 abut against the second limiting blocks 134 to limit a rotation angle between the fan shell 10 and the supporting shell 20. By the arrangement of the above structure, during use, when the rotating shafts 24 rotate certain angles in the rotating shaft holes 131, the first limiting blocks 242 abut against the second limiting blocks 134 to hinder further rotation between the fan shell 10 and the supporting shell 20 and restrain an angle between them, so that the fan shell 10 and the supporting shell 20 can only rotate in a certain angle. This improves the stability of the product.

In this embodiment, each sliding shell 13 includes a first sliding shell **13*a* and a second sliding shell 13*b*; the first sliding shell 13*a* and the second sliding shell 13*b* are both provided with arc-shaped grooves; the first sliding shell 13*a* is connected to the second sliding shell 13*b*; and the two arc-shaped grooves form the rotating shaft hole 131. By the arrangement of the above structure, the first sliding shell 13*a* and the second sliding shell 13*b* can be respectively arranged, which facilitates the production and improves the production efficiency of the product. Moreover, it is also convenient to insert the rotating shaft 24 into the rotating shaft hole 131. Specifically, the two arc-shaped grooves are aligned with the rotating shaft 24, and the first sliding shell 13*a* and the second sliding shell 13*b* are moved towards each other until the rotating shaft hole 131 formed by the two arc-shaped grooves is engaged with the rotating shaft 24. At this time, the first abutment block 241 abuts against the second abutment block 133**, facilitating the assembling of the product.

In this embodiment, the connecting arms 23 are provided with first routing channels 231; the rotating shafts 24 are provided with through holes 243 communicated to the first routing channels 231; and the through holes 243 and the first routing channels 231 are configured to allow electrical connection wires to pass. By the arrangement of the above structure, during use, the electrical connection wires can pass through the first routing channels 231 and the through holes 243 to connect the air supply component 70 inside the fan shell 10 to a battery inside the supporting shell 20. This achieves supplying energy to the air supply component 70, improves the endurance of the product, and facilitates use.

In this embodiment, a first clamping block 102 or a first clamping slot 201 is arranged on one side of the fan shell 10 facing the supporting shell 20, and a first clamping slot 201 or a first clamping block 102 is arranged on one side of the supporting shell 20 facing the fan shell 10; and when the supporting shell 20 is at the storage position, the first clamping block 102 is clamped and inserted into the first clamping slot 201. By the arrangement of the above structure, when the supporting shell 20 is at the storage position, the first clamping block 102 is clamped and inserted into the first clamping slot 201, which can limit the relative rotation between the supporting shell 20 and the fan shell 10, further improving the stability of the product at the storage position and facilitating the user to move and transport the product.

In this embodiment, the fan shell 10 is provided with an air inlet 103 and an air outlet 104; protruding edges 108 are arranged on one side, close to the air outlet 104, of portions of the fan shell 10 corresponding to the openings 101; and the edges 108 abut against side surfaces of the connecting arms 23 to hinder the supporting shell 20 from rotating to a front side of the air outlet 104. By the arrangement of the above structure, during use, when the edges 108 abut against the surfaces of the connecting arms 23, the supporting shell 20 can be hindered from rotating to the front side of the air outlet 104, so that the supporting shell 20 can only rotate to a rear side of the air outlet 104 of the fan shell. When the product is in an open state, there is no obstruction in front of the air outlet 104. This improves the energy utilization rate and facilitates use.

In this embodiment, the folding desk fan further includes a routing shell 14; the routing shell 14 is connected to an inner wall of the fan shell 10; a second routing channel 109 is formed between the routing shell 14 and the fan shell 10; and the second routing channel 109 is configured to allow an electrical connection wire to pass. By the arrangement of the above structure, the routing shell 14 can limit the electrical connection wire in the second routing channel 109 to prevent scratches on the electrical connection wire when a fan blade rotates, which improves the stability and safety of the product. Meanwhile, the electrical connection wire can also be effectively hidden, which improves the aesthetics of the product. Moreover, the separately arranged routing shell 14 is also convenient for production, and it improves the production efficiency of the product.

In this embodiment, the fan shell 10 includes a first fan shell 11 and a second fan shell 12; one of the first fan shell 11 and the second fan shell 12 is provided with a second clamping block 121, and the other one of the first fan shell 11 and the second fan shell 12 is provided with a second clamping slot 111; and the second clamping block 121 is clamped to the second clamping slot 111. By the arrangement of the above structure, the first fan shell 11 and the second fan shell 12 are respectively arranged, which can improve the production efficiency of the product. Meanwhile, during assembling of the product, parts such as the air supply component, the sliding shells 13, and the routing shell 14 are mounted more easily, and the assembling efficiency of the product is improved. Moreover, the second clamping block 121 is clamped to the second clamping slot 111, so that stable connection between the first fan shell 11 and the second fan shell 12 can be achieved.

In this embodiment, the supporting shell 20 includes a first supporting shell 21 and a second supporting shell 22; one of the first supporting shell 21 and the second supporting shell 22 is provided with a third clamping block 221, and the other one of the first supporting shell 21 and the second supporting shell 22 is provided with a third clamping slot 211; the third clamping block 221 is clamped to the third clamping slot 211; and an accommodating chamber 202 is formed between the first supporting shell 21 and the second supporting shell 22. By the arrangement of the above structure, the first supporting shell 21 and the second supporting shell 22 are respectively arranged, which can improve the production efficiency of the product. Meanwhile, the accommodating chamber 202 formed between the two supporting shells can also be configured to mount a battery, a circuit board, and other structures to improve the space utilization rate of the product. The product is also easier to mount during assembling. Moreover, the third clamping block 221 is connected to the third clamping slot 211, which can also ensure the stability of the connection between the first supporting shell 21 and the second supporting shell 22.

In this embodiment, a control device 50 is arranged in the accommodating chamber 202; and the control device 50 is electrically connected to and controls the air supply component 70. By the arrangement of the above structure, the user can control start or stop of the air supply component 70 through the control device 50 during use, and can also adjust the power of the air supply component 70 to adjust an air speed and a wind force, making it convenient for the user to adjust the product according to different usage needs.

In this embodiment, the folding desk fan further includes a battery 60; and the battery 60 is electrically connected to the control device 50 and supplies power to the control device 50 and the air supply component 70. By the arrangement of the above structure, the battery 60 can provide electrical energy, which effectively improves the endurance of the product. Moreover, the product is allowed to be used without an external power supply such as mains power. This improves the programming ability of the product and facilitates carrying and use. The product is applicable to more diverse usage scenarios.

In this embodiment, the folding desk fan further includes a charging head 51; the charging head 51 is electrically connected to the control device 50; a charging hole 222 is arranged on the second supporting shell 22; and the charging head 51 is threaded through the charging hole 222. By the arrangement of the above structure, during use, a charging end of the external power supply is electrically connected to the charging head 51, which can supply power to the product. The connection is convenient, the use is simple, and the endurance of the product can be effectively improved. The product is energy-saving and environmentally friendly.

In this embodiment, the folding desk fan further includes an indicator lamp 52; the indicator lamp 52 is electrically connected to the control device 50; the first supporting shell 21 is provided with an indicator lamp hole 212; and light generated by the indicator lamp 52 passes through the indicator lamp hole 212. By the arrangement of the above structure, the user can intuitively know a working status of the product through the indicator lamp 52. For example, the remaining power of the battery 60 in the product or the working power of the air supply component 70 at this time can be obtained by a quantity of indicator lamps that are turned on. Or, a charging or battery status of the product can be obtained based on a color or a flashing status of the indicator lamp 52, which effectively helps the user understand a status of the product and facilitates use.

In this embodiment, the folding desk fan further includes a button 80; a button hole 213 is arranged on the first supporting shell 21; a button contact 53 is arranged on the control device 50; and the button 80 is connected to the first supporting shell 21 and the button contact 53 and is threaded through the button hole 213. By the arrangement of the above structure, during use, the user can press or touch the button 80 to trigger the button contact 53, thus generating an electrical signal. The control device 50 receives the electrical signal and controls the air supply component 70 to be turned on or turned off, or adjusts the output power of the air supply component 70. Through the button 80, human-machine interactions can be achieved, making it convenient for the user to control the product.

In this embodiment, the air supply component 70 includes a motor 71 and a fan blade 72; and an output end of the motor 71 is connected to the fan blade and drives the fan blade to rotate. By the arrangement of the above structure, during use, the motor 71 rotates to drive the fan blade 72 to rotate, which can generate an air flow.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

The invention claimed is:

1. A folding desk fan, comprising:

a fan shell, wherein the fan shell is provided with an air supply component, and elongated openings are arranged on two sides of the fan shell;

a supporting shell, wherein two sides of the supporting shell extend upwards to form two connecting arms; free ends of the connecting arms are oppositely provided with two rotating shafts; the rotating shafts are inserted along the openings; the rotating shafts are able to rotate in the openings and slide in lengthwise directions of the openings to cause the supporting shell to move between a storage position and an open position; and damping members, wherein the damping members are connected to the rotating shafts and are located between the rotating shafts and the fan shell; and the damping members are configured to hinder relative rotation between the rotating shafts and the fan shell;

wherein the fan shell comprises sliding shells; the sliding shells are slidably arranged at positions, close to the openings, in the fan shell; the sliding shells are provided with rotating shaft holes; the rotating shafts are rotatably inserted into the rotating shaft holes; and the damping members are arranged between the rotating shafts and the rotating shaft holes;

wherein first abutment blocks are arranged at free ends of the rotating shafts in a protruding manner; second abutment blocks are arranged on inner walls of the rotating shaft holes in a protruding manner; the second abutment blocks abut against the damping members to clamp the damping members between the rotating shafts and the second abutment blocks; and the second abutment blocks abut against the first abutment blocks to restrain the rotating shafts from moving in an axial direction.

2. The folding desk fan according to claim 1, wherein a guide rail block is arranged on an inner wall of the fan shell in a protruding manner; a sliding space is formed between the guide rail block and the inner wall of the fan shell where the openings are located; and the sliding shells slide in the sliding space.

3. The folding desk fan according to claim 1, wherein a first limiting clamping block is arranged on a surface of each sliding shell; a second limiting clamping block is arranged on an inner wall of the fan shell in a protruding manner; and when the supporting shell is at the storage position, the first limiting clamping block is clamped to the second limiting clamping block.

4. The folding desk fan according to claim 1, wherein surfaces of the first abutment blocks in a circumferential direction protrude to form first limiting blocks; second limiting blocks are further arranged on inner walls of the rotating shaft holes; the first limiting blocks abut against the second limiting blocks to limit a rotation angle between the fan shell and the supporting shell.

5. The folding desk fan according to claim 1, wherein each sliding shell comprises a first sliding shell and a second sliding shell; the first sliding shell and the second sliding shell are both provided with arc-shaped grooves; the first sliding shell is connected to the second sliding shell; and the two arc-shaped grooves form the rotating shaft hole.

6. The folding desk fan according to claim 1, wherein the connecting arms are provided with first routing channels; the rotating shafts are provided with through holes communicated to the first routing channels; and the through holes and the first routing channels are configured to allow electrical connection wires to pass.

7. The folding desk fan according to claim 1, wherein one of a first clamping block or a first clamping slot is arranged on one side of the fan shell facing the supporting shell, and the other one of the first clamping slot or the first clamping block is arranged on one side of the supporting shell facing the fan shell; and when the supporting shell is at the storage position, the first clamping block is clamped and inserted into the first clamping slot.

8. The folding desk fan according to claim 1, wherein the fan shell is provided with an air inlet and an air outlet; protruding edges are arranged on one side, close to the air outlet, of portions of the fan shell corresponding to the openings; and the edges abut against side surfaces of the connecting arms to hinder the supporting shell from rotating to a front side of the air outlet.

9. The folding desk fan according to claim 1, further comprising a routing shell, wherein the routing shell is connected to an inner wall of the fan shell; a routing channel is formed between the routing shell and the fan shell; and the routing channel is configured to allow an electrical connection wire to pass.

10. The folding desk fan according to claim 1, wherein the fan shell comprises a first fan shell and a second fan shell; one of the first fan shell and the second fan shell is provided with a clamping block, and the other one of the first fan shell and the second fan shell is provided with a clamping slot; and the clamping block is clamped to the clamping slot.

11. The folding desk fan according to claim 1, wherein the supporting shell comprises a first supporting shell and a second supporting shell; one of the first supporting shell and the second supporting shell is provided with a clamping block, and the other one of the first supporting shell and the second supporting shell is provided with a clamping slot; the clamping block is clamped to the clamping slot; and an accommodating chamber is formed between the first supporting shell and the second supporting shell.

12. A folding desk fan, comprising:

a fan shell, wherein the fan shell is provided with an air supply component, and elongated openings are arranged on two sides of the fan shell;

a supporting shell, wherein two sides of the supporting shell extend upwards to form two connecting arms; free ends of the connecting arms are oppositely provided with two rotating shafts; the rotating shafts are inserted along the openings; the rotating shafts are able to rotate in the openings and slide in lengthwise directions of the openings to cause the supporting shell to move between a storage position and an open position; and damping members, wherein the damping members are connected to the rotating shafts and are located between the rotating shafts and the fan shell; and the damping members are configured to hinder relative rotation between the rotating shafts and the fan shell;

wherein the supporting shell comprises a first supporting shell and a second supporting shell; one of the first supporting shell and the second supporting shell is provided with a clamping block, and the other one of the first supporting shell and the second supporting shell is provided with a clamping slot; the clamping block is clamped to the clamping slot; and an accommodating chamber is formed between the first supporting shell and the second supporting shell;

wherein a control device is arranged in the accommodating chamber; and the control device is electrically connected to and controls the air supply component.

13. The folding desk fan according to claim 12, further comprising a battery, wherein the battery is electrically connected to the control device and supplies power to the control device and the air supply component.

14. The folding desk fan according to claim 13, further comprising a charging head, wherein the charging head is electrically connected to the control device; a charging hole is arranged on the second supporting shell; and the charging head is threaded through the charging hole.

15. The folding desk fan according to claim 12, further comprising an indicator lamp, wherein the indicator lamp is electrically connected to the control device; the first supporting shell is provided with an indicator lamp hole; and light generated by the indicator lamp passes through the indicator lamp hole.

16. The folding desk fan according to claim 12, further comprising a button, wherein a button hole is arranged on the first supporting shell; a button contact is arranged on the control device; and the button is connected to the first supporting shell and the button contact and is threaded through the button hole.

17. The folding desk fan according to claim 12, wherein the air supply component comprises a motor and a fan blade; and an output end of the motor is connected to the fan blade and drives the fan blade to rotate.

* * * * *